US005256859A

United States Patent [19]

Nanos et al.

[11] Patent Number: 5,256,859

[45] Date of Patent: Oct. 26, 1993

[54] POWER SUPPLY FOR BINDING APPARATUS

[75] Inventors: Nicholas M. Nanos, Morton Grove; Alfredo J. Vercillo, Harwood Heights, both of Ill.

[73] Assignee: General Binding Corporation, Northbrook, Ill.

[21] Appl. No.: 715,575

[22] Filed: Jun. 14, 1991

[51] Int. Cl.[5] ..... H05B 1/02

[52] U.S. Cl. ..... 219/492; 219/518; 219/497; 412/33; 412/901; 156/583.9

[58] Field of Search ..... 219/492, 518, 497, 494, 219/493; 412/33, 901; 156/272.2, 583.9

[56] References Cited

U.S. PATENT DOCUMENTS 2,644,151 6/1953 Krueger ..... 219/492
4,367,116 1/1983 Wilholm ..... 219/518
4,378,266 3/1983 Gerken ..... 219/492
4,506,144 3/1985 Hesford ..... 219/497
4,855,573 8/1989 Vercillo et al. ..... 219/492

*Primary Examiner*—Mark H. Paschall
*Attorney, Agent, or Firm*—Hill, Steadman & Simpson

[57] ABSTRACT

A control circuit for a binding apparatus using a binder covers having resistance heating strips in a heat activated adhesive includes a power control to output a constant power to the heating strip. A duty cycle of the power signal supplied to the heating strip is controlled dependent upon the resistance of the strip. Fault detection circuitry indicates an open circuit in the resistance strip and interrupts the power supply. A stress test is performed by a high voltage generator which emits a high voltage pulse at the start of the binding cycle to stress the connections in the binder cover and thereby cause failure of any weak connections before the binding cycle is underway. A timer circuit is also disclosed.

11 Claims, 3 Drawing Sheets

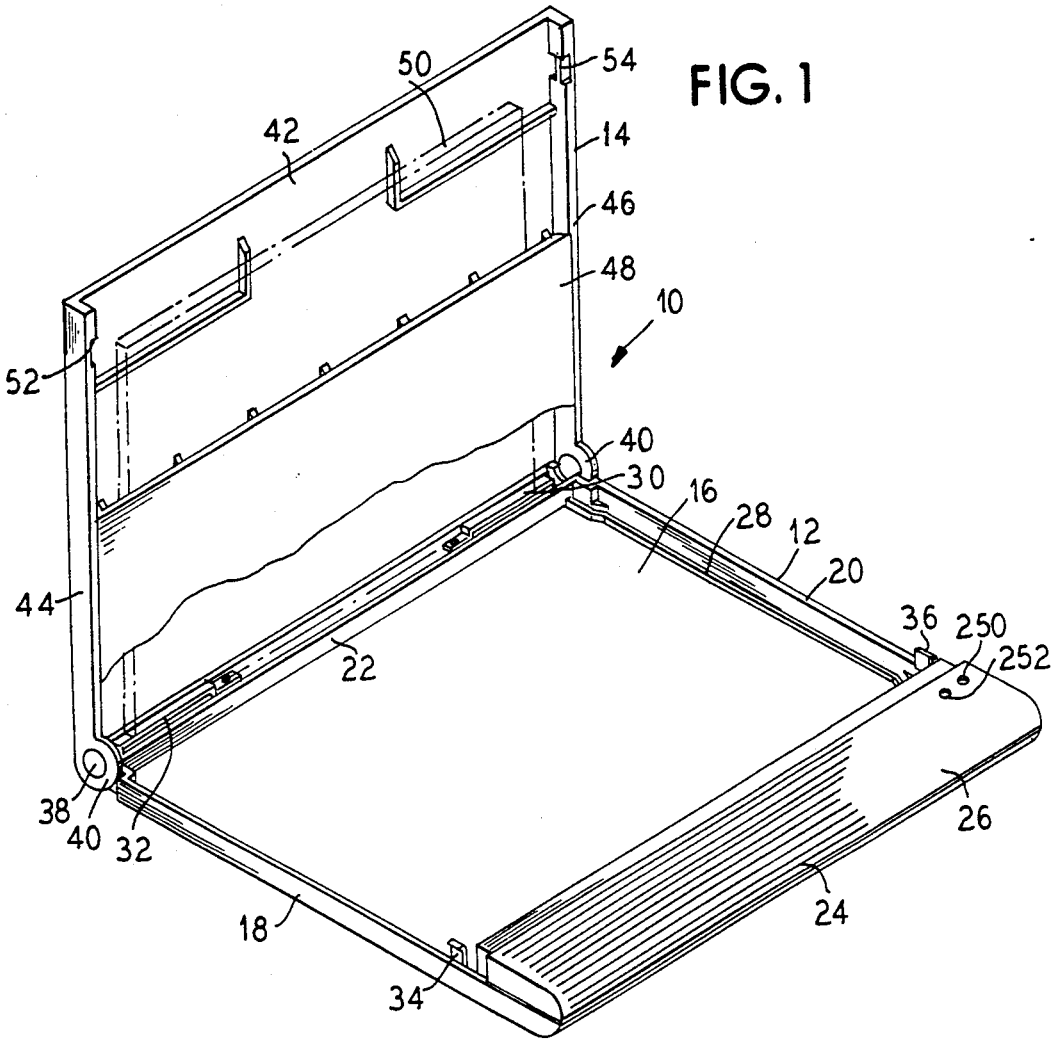
FIG. 1
FIG. 2
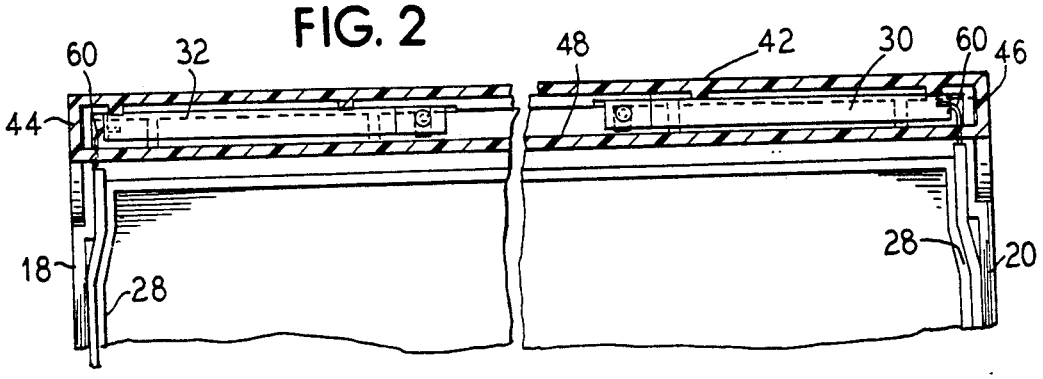

POWER SUPPLY FOR BINDING APPARATUS

BACKGROUND OF THE INVENTION

1. Field of the Invention

The present invention relates generally to a binding apparatus for binding loose sheets to form a book-like unit and, more particularly, to a power supply circuit for controlling a binding apparatus.

2. Description of the Related Art

An electrically heated binding apparatus is disclosed in U.S. Pat. No. 4,855,573. The binding apparatus includes a housing with a base connected by a hinge to a cover in which is formed a binding compartment into which a binder cover with sheets to be bound are inserted. The bottom of the binding compartment is provided with electrical contacts which bear against contacts on the binder cover when it is inserted into the binding compartment. The binding cover includes a heat-activated adhesive and an electrical resistance strip to heat the adhesive. An electrical control circuit, which includes timing circuitry for applying binding current for a predetermined length of time, is within the binding apparatus connected to the electrical contacts in the binding compartment. The application of the current is also known as the binding cycle, which is of a set duration.

The electrical resistance strip in the binder covers, or booklets, commonly used, for example, in the known binding apparatus are generally of a low resistance value, for example, of 7 ohms. Since such binder covers are mass produced, a range of resistance values of, for example, 4 to 9 ohms occurs, which although small in an absolute sense is quite large in a relative sense due to the low resistance values, thus resulting in a wide percentage range in the resistances among the individual binder covers. The large percentage change in the resistance causes a corresponding large percentage change in the power drawn by the resistance strip, which in turn results in unpredictable binding. For instance, lower resistance values draw more power so that greater heat is generated by the heating element in the binder cover, which results in discoloration, scorching, and occasionally in burning of the binder cover or vaporization of the adhesive. Higher resistance values for the heating elements draw less power so that, in some instances, the pages are not completely bound in the binder cover.

Another problem which occasionally occurs as a result of, for example, mass produced binder covers is that electrical connections between the contacts and the resistance strip or the continuity of the strip itself may be weak or even lacking altogether so that proper binding of the pages does not occur in the binding cycle. While the known apparatus will detect an open circuit that occurs during the binding cycle, a weak connection is not detected until failure of the connection at some point during the binding cycle. This can result in partially bound books, which can be worse than no binding at all.

SUMMARY OF THE INVENTION

A binding apparatus control circuit according to the present invention provides a constant application of power to the resistance strip of a binder cover, regardless of variations in resistance, and thereby insures proper binding.

The present control circuit also prevents burning or scorching of the binder cover, or overheating of the adhesive, during the binding or heating cycle of a binding apparatus.

Furthermore, partially bound books are prevented by detection of poor internal connections to and along the resistance heating strip in the binder cover before the full binding cycle is undertaken.

These and other objects and advantages of the invention are achieved in accordance with the principles of the present invention by a control circuit for a binding apparatus having means for applying current to the resistance strip in a binder cover and means for maintaining power applied to the resistance strip of a binder cover at a predetermined level by maintaining the average current generally constant over the binding cycle. The control circuit includes a power control portion that is a constant current generator which controls the current to the resistance strip via variations in the duty cycle, so that the resistance load is essentially normalized. This results in a constant net current to the resistance heating strip.

In addition to controlling the current, the power control circuitry of the present invention tests the integrity of the electrical connections in the binder cover by incorporating a high voltage generator which applies a high energy pulse to the binder cover before or at the very start of the binding cycle. This high energy pulse stresses the electrical connections in the binder cover so that any faulty connection that may be present fails and is then immediately detected before the binding cycle gets underway. Fault detection circuity detects failure of the resistance connection in the binder cover and interrupts the binding cycle. A weak connection which could fail midway through the binding cycle leaving a partially bound book is, therefore, detected and the faulty binder cover can be replaced. Thus, a final quality check is performed on each binder cover immediately prior to the binding cycle.

A start detection circuit portion detects the presence of a binder cover in the binding compartment of the binding apparatus and, upon detection, produces a start signal which initiates the high voltage test and the binding cycle. Operation of the binding apparatus is thus automatic and does not require a start switch to begin operation.

In addition to the foregoing circuit portions, the circuit incorporates a timing means for timing the duration of the binding cycle. The timing means may be any of a variety of timing circuits including analog or digital circuits or microprocessor-controlled timing circuits. One such timing circuit applicable in the present apparatus is disclosed herein.

BRIEF DESCRIPTION OF THE DRAWINGS

FIG. 1 is a perspective view of a binding apparatus, shown with the housing in the open position to reveal a binding compartment, the binding apparatus including a control circuity according to the principles of the present invention;

FIG. 2 is an enlarged fragmentary cross section of the binding compartment of the binding apparatus of FIG. 1 showing electrical contacts in the binding compartment;

DETAILED DESCRIPTION OF THE PREFERRED EMBODIMENTS

The Apparatus

Figure 3:
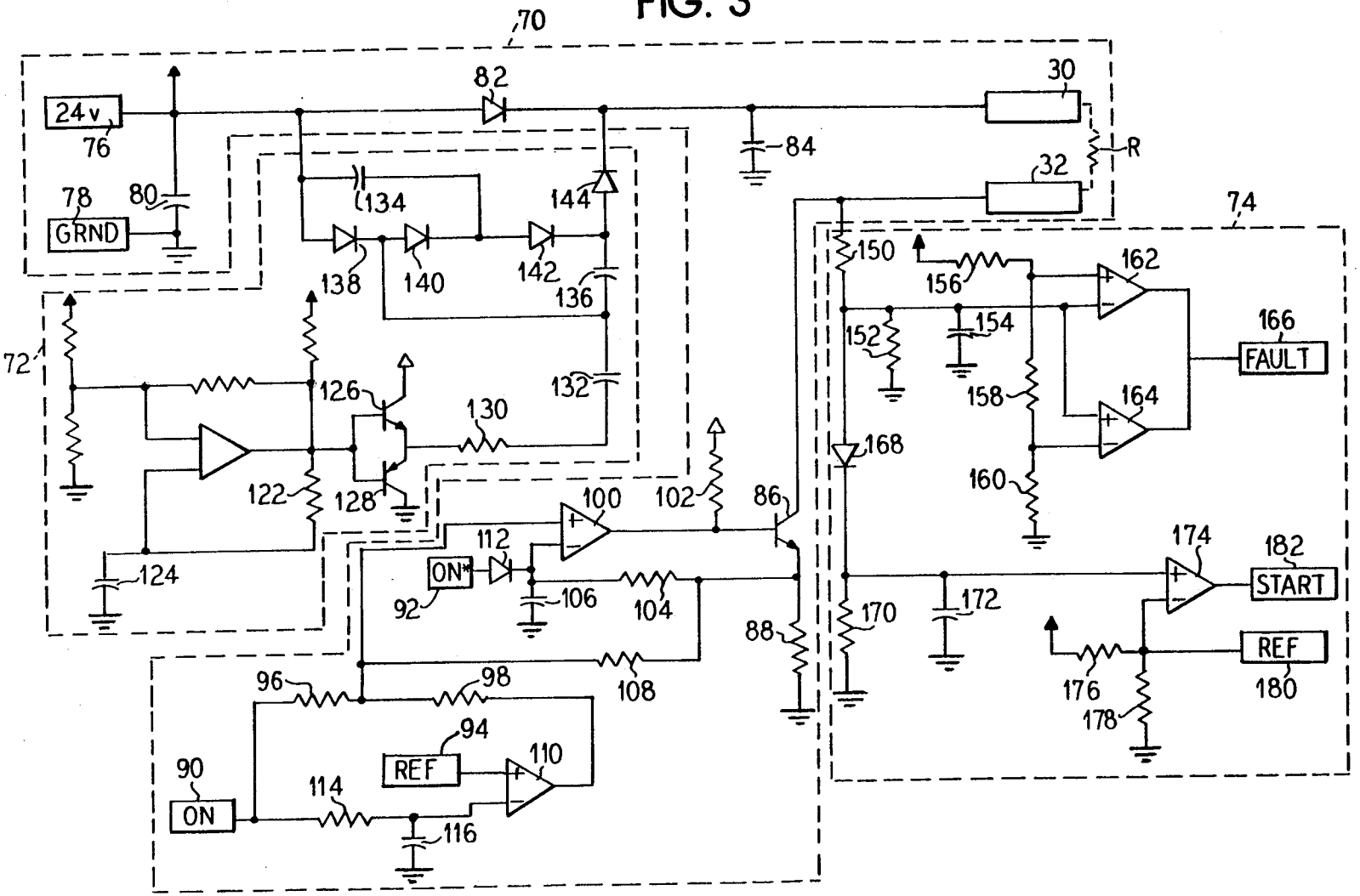
FIG. 3 is a circuit diagram of the control circuitry of the present invention for use in the binding apparatus of FIG. 1.

In FIG. 1, a binding apparatus 10 is shown including a base 12 and a top 14, both of which are preferably formed of molded plastic. The base 12 includes a flat-bottom wall 16, a pair of sidewalls 18 and 20, and a rear wall 22 defining a tray shaped portion. A front enclosure 24 of the base 12 forms the front wall of the tray portion and is shaped as a flattened body with a rounded forward edge. Within the front enclosure 24 is an electronics compartment 26 containing, for example, a circuit board (not shown) on which is provided a control circuit. In the illustration, two indicator lamps 250 and 252 are visible in the front enclosure 24. Wire guide walls 28 are molded into the base 12 adjacent and along each sidewall 18 and 20 to form channels along which wires 60 extend from the electronics compartment 26 to a pair of spaced electrical contacts 30 and 32 in the top 14 of the binding apparatus. A pair of latch tongues 34 and 36 ar molded integrally with the respective sidewalls 18 and 20 adjacent the front edge thereof.

The top 14 is connected by a hinge construction 38 to the rear wall 22 of the base 12. The sidewalls 18 and 20 are recessed inwardly near the rear wall 22 to receive the hinge construction. The hinge construction 38 includes a pair of hinge disks 36 molded at either side of the rear of the base 12 as well as a pair of circular surrounding hinge portions 40 on either side of the top 14 which are snap-fitted together to form the hinge.

The top 14 defines a binding compartment which is formed by an outer or top wall 42, sidewalls 44 and 46, and an inner compartment wall 48. The binding compartment is open at the top to receive binder covers into which have been inserted loose sheets of paper, such as a binder cover 50 shown in phantom in FIG. 1. At the bottom of the binding compartment, the binder cover 50 has access to the electrical contacts 30 and 32 so that the binder cover 50 is electrically connected across the contacts 30 and 32 when in the binding compartment. Molded into the sidewalls 44 and 46 of the top 14 are latch receiving recesses 52 and 54 for receiving the latch tongues 34 and 36, respectively, of the base 12.

The binding apparatus of FIG. 1 is shown in the open position in which it is operated to bind loose sheets in binder cover. The vertical orientation of the top 14 in the open position insures that the loose sheets remain in position during the binding process. Between uses, the top 14 is folded down over the base 12 to form a compact, closed unit that is easily and unobtrusively stored.

In FIG. 2 can be seen the elongated metal strips which form the contacts 30 and 32, the strips being connected by the wires 60 which lead to the control circuit compartment 26 in the front enclosure 24.

The binder cover 50 used in the present binding apparatus is commercially available under the trade name THERMA-BIND (a registered trademark of General Binding Corporation). The binder cover includes a front and rear cover of a sturdy material such as paperboard or plastic sheet joined by a spine. The spine includes a layer of heat activated adhesive along with an electrical resistance strip forming a heating element extending along the spine in thermal contact with the adhesive. The outer surface of the spine includes a pair of spaced electrical contacts, such as rivets, which are electrically connected to the resistance strip. When the binder cover is placed into the binding compartment, the rivets are in electrical contact with the contacts 30 and 32 in the binding apparatus. Loose pages to be bound are placed into the binder cover and the assembled binder is set into the binding compartment of the illustrated binding apparatus. An electrical current is applied to the contacts in the spine of the binder cover to heat the adhesive and thereby bind the pages into the cover.

The Circuitry

Referring now to the circuit diagram of FIG. 3, the circuit may be divided into various functional portions which are delineated by broken outline in the FIG. 3. The first portion of the control circuit is a power control 70, while a second portion is a high-voltage generator 72 and a third portion of the illustrated circuit is a fault detector 74. The circuit description will begin with the operation of the power control 70.

Inputs to the power control portion of the control circuity include a supply voltage input 76 and a ground input 78. In the exemplary embodiment, the supply voltage input 76 receives a 24 volt DC signal, such as from a power transformer connected to the binding apparatus. Across the inputs 76 and 78 is connected a filter capacitor 80 for smoothing any ripple which may appear in the input power signal. The current flows from the input through a diode 82 and across a second filtering capacitor 84 before being applied to the electrical contact strip 30, which forms the positive lead of the load represented by the resistance R of the resistance heating strip in the binder cover, as shown in phantom. The other contact strip 32 in the binding apparatus is connected to ground via a bi-polar transistor 86 and a resistor 88, although it is of course possible to replace the bi-polar transistor 86 with some other switching element.

The operation of the power control is initiated by a pair of signals which are the inverse of one another, the first being an ON signal applied at lead 90 and the inverse thereof being an ON* signal applied at lead 92 in the power control portion 70. A reference voltage is also supplied to a lead 94. When the 0N signal is applied to the lead 90, resistors 96 and 98 function as a voltage divider to produce a first voltage at the junction thereof. This first voltage is applied to the positive input of an operational amplifier 100 connected as an oscillator. The output of the operational amplifier 100 is tied to the base of the bi-polar transistor 86 via a pull-up resistor 102 so that the transistor 86 is driven in accordance with the cycling of the oscillator 100. A feedback loop connected to the negative input of the operational amplifier 100 is taken from the voltage across of the resistor 88 and through the RC time delay network 104 and 106. A resistor 108 provides hysteresis for the oscillator circuit. This circuit will try to maintain a voltage across the resistor 88 which is on average equal to the voltage at the junction of the voltage divider 96 and 98, which is accomplished via control of the duty cycle for the oscillator. The output current in a preferred embodiment is 1.27 amps. The duty cycle control tends to normalize the resistance across the load contacts 30 and 32 to provide a constant net current. For instance, the duty cycle for an 8 ohm load will be twice as long as the duty cycle for a 4 ohm load.

The foregoing circuit description assumes that the ON signal at lead 90 is high and the ON* signal at lead 92 is low. The timer from which these signals originate and which will be described in more detail hereinafter turns on the power control by transmitting a high ON signal for the duration of the binding cycle and turns off the power control regulator at the end of the binding cycle. To turn the power off, the ON signal at lead 90 goes to 0 volts which also causes a low at the output of an operational amplifier 110 connected as a comparator so that no voltage is applied to either end of the voltage divider 96 and 98. The inverse signal ON* is applied as a high to the negative or inverting input of the operational amplifier 100 through a diode 112. Since the positive input terminal of the operational amplifier 100 is at ground and the negative input is at a positive voltage, the output of the operational amplifier is clamped to ground and the oscillator is turned off.

When the ON signal changes state and goes to a positive voltage while the ON* signal simultaneously goes to ground at the beginning of the binding cycle, the diode 112 is essentially disconnected. The ON signal passes through the voltage divider 96 and 98 as well as through an RC network 114 and 116 at the negative input of the operational amplifier 110. When the ON signal first changes state, the negative input of the operational amplifier 110 is below the reference voltage at lead 94, which causes the output of the operational amplifier 110 to be high, resulting in a relatively high voltage being applied to the positive input terminal of the operational amplifier 100. This causes the transistor 86 to remain on and discharge the high energy capacitor 84 through the resistance heating strip in the binder cover. After a very brief time, such as after 50 milliseconds, the voltage across the capacitor 116 charges to the reference voltage level so that the output of the operational amplifier goes low, causing the circuit to behave as the constant current source as described above.

At the start of the binding cycle, a high energy pulse is applied to the resistance strip of the binder cover. The high voltage, such as approximately 65 volts, is generated by a charge pump in the high voltage generator 72. The heart of the circuit is an operational amplifier 120 which is wired as a oscillator, the frequency of which is determined by an RC circuit 122 and 124. In a preferred embodiment, the frequency of the oscillator is approximately 453 Hz. An emitter-follower pair of transistors 126 and 128 are connected at the output of the oscillator to buffer the output, since the operational amplifier 120 is an open collector circuit. Peak currents are limited by a resistor 130. A square wave pulse which passes through the resistor 130 is fed to a voltage tripler circuit made up of a capacitor 132, a capacitor 134, a capacitor 136, and diodes 138, 140, 142, and 144. The high voltage pulse resulting from this circuit is stored in the high energy storage capacitor 84 which is discharged across the load under the control of the transistor 86.

The pulse emitted from the high voltage generator stresses the connections in the binder cover so that any weak connections are immediately broken or interrupted. This eliminates the possibility that a weak connection may break midway through a binding cycle resulting in a partially bound book. The open circuit resulting from the stressing of a weak connection by the test pulse, or an initially open circuit, is detected by a fault detection circuit 74. The resistance of the resistance strip R is measured via the duty cycle of the output waveform. In the fault detection circuit, a current limiter resistor 150, which also acts as half of a voltage divider along with a resistor 152, is connected to the negative contact strip 32. The signal from this contact strip, after being divided by the voltage divider, is filtered although a capacitor 154 to generate a voltage which is proportional to the duty cycle applied to the binder cover. The resulting voltage is fed to a window comparator formed by voltage divider resistors 156, 158 and 160 and operational amplifiers 162 and 164. The voltage divider resistors 156, 158 and 160 generate high and low limit voltages for the window comparator 162 and 164. The outputs of the operational amplifiers 162 and 164 are tied together in a logical "OR" function, since the operational amplifiers are open collector circuits. The resulting fault signal is available at lead 166 which is connected into the timing circuit to be described later.

Not only does the fault detection circuitry 74 detect faults and open circuits occurring in the binder cover, but the circuit is also used to detect the presence of a book initially to start the binding cycle. The filtered voltage from the voltage divider 150 and 152 and the filter capacitor 154 is fed through a diode 168 to a debouncing resistor 170 and a capacitor 172 where it is compared at the positive input of an operational amplifier 174 to the reference voltage supplied to the negative input thereof. The reference voltage is generated by a voltage divider circuit composed of resistors 176 and 178, and is not only fed to the negative input of the operational amplifier 174, but also to a reference voltage lead 180 which is connected to other reference voltage leads, including the reference voltage lead 94. This start detection portion of the circuitry detects peak voltages caused when a binder cover initially contacts the contact strips 30 and 32. The resistor 170 provides a slow bleed off of the charge on the capacitor 172.

Thus, there has been shown and described a power control circuit for use in a binding apparatus. The circuit detects the presence of a binder cover connected across the contact strips 30 and 32, applies a high voltage stress pulse initially to stress any weak connections therein, and subsequently applies a constant current signal across the leads for as long as the ON signal is present. The power regulation capabilities of the illustrated circuit, in a preferred embodiment, enable binder covers having resistance strips in a resistance range of from 3 ohms through 12 ohms to be used, although an even broader range of resistance values may successfully be bound by the present circuit. The illustrated circuit also interrupts the signal upon the detection of a fault in the load across the contact strips 30 and 32.

Figure 4:
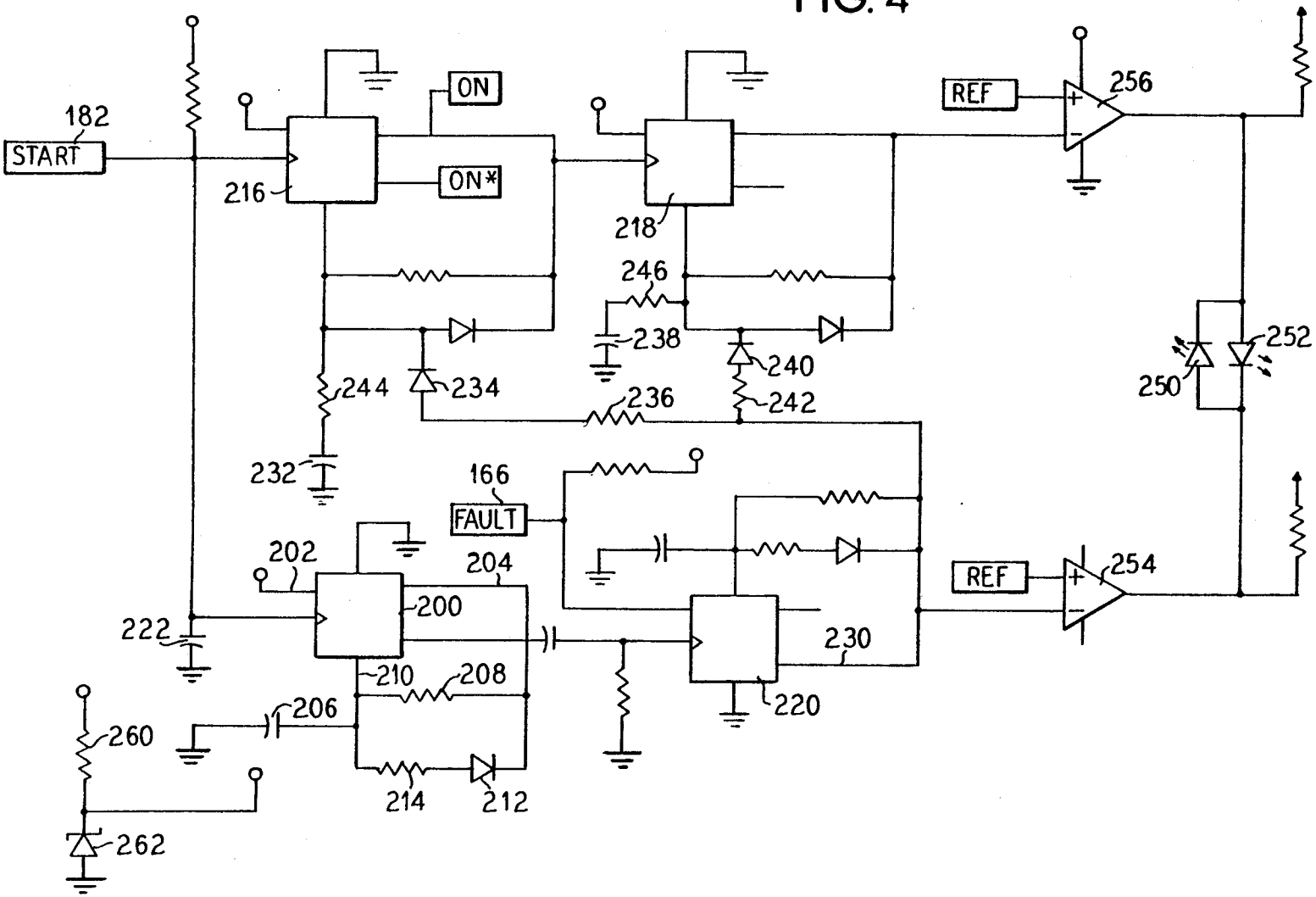
FIG. 4 is a circuit diagram of a timing circuit for use with the control circuit of FIG. 3.

The duration of the constant current signal from the illustrated power control circuit of FIG. 3 is controlled by a timer which sets a predetermined time interval, such as 45 seconds, for the duration of the binding cycle. Although a variety of known timer means may be used including microprocessor controlled timer means, an exemplary embodiment of a timer circuit is shown in FIG. 4. The illustrated timer includes four nonstable elements each consisting of, for example, a model 4013 CMOS flip-flop. For example, a flip-flop 200 is triggered at the rising edge of a clock signal so that a high at an input 202 results in an output 204 going high and charging a capacitor 206 through a resistor 208. The voltage across the capacitor 206 is applied to a reset input 210, which resets the flip-flop 200 when the threshold level at the reset input is reached. This causes the output 204 to go low and rapidly discharges the capacitor 206 through a diode 212. A resistor 214 limits the current flow during the discharge. Similar operational connections are provided for each of the remaining three flip-flops 216, 218, and 220.

To initiate operation of the timer circuit in FIG. 4, a start signal is applied at the lead 182 from the start detection circuitry shown in FIG. 3. This start signal is filtered by a capacitor 222 and applied to the clock inputs of the flip-flops 200 and 216. The flip-flop 216 is the power timer and is set to time a duration of, for example, 45 seconds. When the flip-flop 216 is triggered, it results in a triggering pulse to the clock input of the flip-flop 218 which is a lamp timer. The flip-flop 218 is set for a timing period of, for example, 60 seconds. The triggering of the flip-flop 216 to the power-on state transmits the ON and ON* changes of signal state to the power control circuitry of FIG. 3.

At the same time that the power cycle has began, the flip- flop 200 is triggered, which, when it times out causes the flip-flop 220 to trigger. The flip-flop 220 senses faults received over the fault detection lead 166. If the fault line 166 is high, indicating no fault, an output 230 remains low and timing proceeds normally, If, on the other hand, the fault signal on lead 166 is high, indicating that the binder cover is out of specification, (the presence of a fault), the output 230 goes high, which rapidly charges a capacitor 232 via a diode 234 and resistor 236. Simultaneously, a capacitor 238 is charged via a diode 240 and a resistor 242, thereby effectively resetting the flip-flops 116 and 118 by causing them to complete their timing periods early. Resistors 244 and 246 are provided to force the flip-flops 216 and 218, respectively, to go to their reset state and stay there. These resistors also provide some current limiting.

The delay in the circuit initiated by the flip-flop 200, which is preferably approximately 0.7 seconds, allows the fault signal on lead 166 to stabilize before testing is undertaken by the flip-flop 220.

Not only does the flip-flop 220 cause resetting of the flip-flops 216 and 218, but this flop-flop 220 also drives an indicator LED to a fault indicating state to indicate to the user of the binding apparatus the presence of a fault. For instance, an LED pair 250 and 252 connected back-to-back is a combination red/green LED, the color of which is dependent upon the direction of current flow through the LED pair. A high signal from the output of an operational amplifier 254 will cause the LED pair 250 and 252 to illuminate in a red color to indicate a fault in the book binding. On the other hand, a high signal at an output of an operational amplifier 256 causes the LED pair 250 and 252 to illuminate in a green illuminated state, the operational amplifiers 254 and 256 thus being connected as LED drivers. If both operational amplifiers 254 and 256 are driven, the LED is turned off.

The illustrated timer circuit checks the fault lead 166 each time a binder cover is inserted into the binding apparatus. This makes it possible to truncate the binding cycle by removing the binder cover, waiting a few seconds, inserting the binder cover and removing it again immediately. This works because inserting the binder cover triggers the flip-flop 200 and removing the cover quickly activates the fault signal on lead 166.

A resistor 260 and a zener diode 262 are provided to drop the supply voltage of, preferably, 24 volts, down to a voltage of, for example, 12 volts, which is compatible to the CMOS flip-flop circuits and the timer.

Although other modifications and changes may be suggested by those skilled in the art, it is the intention of the inventors to embody within the patent warranted hereon all changes and modifications as reasonably and properly come within the scope of their contribution to the art.

We claim:

1. A power supply for a binding apparatus for use with binder covers each having resistance heating element and a heat activated binder material heatable by the heating element, where different resistance heating elements may be of mutually different resistance values, comprising:

means for supplying current to a heating element of a binder cover for a predetermined period of time corresponding to a binding cycle; and means for controlling the current supplied by said means for supplying so that an average current supplied to one of the heating elements over one of said binding cycles is substantially the same as an average current supplied to another of heating elements over a previous or subsequent binding cycle regardless of differences in resistance of the heating elements.

2. A power supply as claimed in claim 1, wherein said means for supplying current comprises an oscillator connected to supply current pulses having an on/off duty cycle to the heating element, and said means for controlling comprises means for controlling the on/off duty cycle of said current pulses supplied to said heating element.

3. A power supply as claimed in claim 1, further comprising:

means for applying a high current pulse to the heating element at a beginning of said binding cycle, said high current pulse being of an amplitude substantially greater than said average current and a duration substantially shorter than said predetermined period of time.

4. A power supply as claimed in claim 3, further comprising:

fault detecting means for detecting an open circuit occurring in the heating element during said high current pulse, said fault detecting means connected to said means for supplying to cause an interruption of the supply of current to the heating element upon detection of an open circuit.

5. A power supply as claimed in claim 1, further comprising:

means for detecting an initial connection of the heating element to said means for supplying current, said means for detecting being connected to said means for supplying to trigger a start of said binding cycle.

6. A power supply as claimed in claim 1, further comprising:

fault detecting means for detecting an open circuit occurring in the heating element during said binding cycle, said fault detecting means connected to said means for supplying to cause an interruption of the supply of current to the heating element upon detection of an open circuit.

7. A power supply for supplying current to a resistance strip in a heat activated binder cover through a pair of spaced contacts on the binder cover, comprising:

first and second contacts mounted for electrical contact with a pair of spaced contacts on a binder cover;

a start detection circuit connected to said first and second contacts and having an output from which is emitted a start signal upon detection of a load across said first and second contacts;

a high voltage generator having an input connected to said output of said start detection circuit and an output connected to said first and second contacts to produce a high voltage pulse across said first and second contacts upon receiving the start signal from said start detection circuit;

a fault detection circuit having an input connected to said first and second contacts and an output from which is emitted an interrupt signal upon detection of an open circuit across said first and second contacts; and a power control circuit having a first input connected to said output of said start detection circuit to initiate a binding cycle upon receipt of the start signal and a second input connected to said output of said fault detection circuit to interrupt the binding cycle upon receipt of said interrupt signal, said power control circuit having an output connected to said first and second contacts at which a binding signal of substantially constant average current is produced during the binding cycle.

8. A power supply as claimed in claim 7, wherein said power control circuit is a pulse circuit producing a pulse signal at said first and second contacts as said binding signal.

9. A power supply as claimed in claim 7, further comprising:

a timer circuit having an input connected to said start detection circuit and an output connected to said power control circuit to initiate the binding cycle upon receipt of the start signal and to end the binding cycle after a predetermined time interval.

10. A control circuit for a binding apparatus for use with binder covers having resistance strips to activate a thermal binding material, comprising:

means for applying DC current during sequential binding cycles to resistance strips in a plurality of binder covers; and means for maintaining power applied to the resistance strips in the binder covers at a substantially constant level during the sequential binding cycles although resistance of the resistance strips differs in the sequential binding cycles.

11. A control circuit for a binding apparatus for use with binder covers having resistance strips to activate a thermal binding material, comprising:

means for applying a first current during a binding cycle to a resistance strip in a binder cover to activate a thermal binding material; and means for applying a pulse having an amplitude greater than said first current to the resistance strip at a beginning of the binding cycle.

* * * * *